US006399876B1

(12) United States Patent
Oakes

(10) Patent No.: US 6,399,876 B1
(45) **Date of Patent: *Jun. 4, 2002**

(54) TRANSFORMER COOLING METHOD AND APPARATUS THEREOF

(75) Inventor: Stephen Preston Oakes, Matthews, NC (US)

(73) Assignee: Square D Company, Palatine, IL (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/359,364

(22) Filed: Jul. 22, 1999

(51) Int. Cl.[7] ..... H01B 9/06; H01B 7/42
(52) U.S. Cl. ..... 174/15.1; 174/15.2
(58) Field of Search ..... 174/15.1, 15.6; 336/60, 55, 61, 58, 57; 361/688, 698, 699, 703

(56) References Cited

U.S. PATENT DOCUMENTS 1,559,180 A * 8/1925 Prat
4,413,674 A * 11/1983 Avery et al. ..... 165/104.33
4,491,817 A * 1/1985 Koyama ..... 336/60
4,921,139 A * 5/1990 Fischer et al. ..... 222/129.1
4,956,626 A * 9/1990 Hoppe et al. ..... 336/60
5,121,613 A * 6/1992 Cox et al. ..... 62/419
5,130,616 A * 7/1992 Owen ..... 318/17
5,167,804 A * 12/1992 Tiggelbeck ..... 210/67
5,212,625 A * 5/1993 Van Andel et al. ..... 361/383
5,216,356 A * 6/1993 Owen ..... 323/361
5,402,542 A * 4/1995 Viard ..... 5/421
5,823,249 A * 10/1998 Batchelder ..... 165/121
5,993,618 A * 11/1999 Schulze et al. ..... 204/237
6,169,674 B1 * 1/2001 Owen ..... 363/64

* cited by examiner

*Primary Examiner*—Dean A. Reichard
*Assistant Examiner*—William H. Mayo, III
(74) *Attorney, Agent, or Firm*—Michael J. Femal; Larry I. Golden

(57) ABSTRACT

This invention relates to a cooling system for a transformer. Cooling panels of a radiator are fluidly connected to the transformer. Plates are positioned adjacent to or toward the ends of the cooling panels to form an enclosed flow path thereby increasing the velocity of air therein.

22 Claims, 13 Drawing Sheets

(4 of 13 Drawing Sheet(s) Filed in Color)

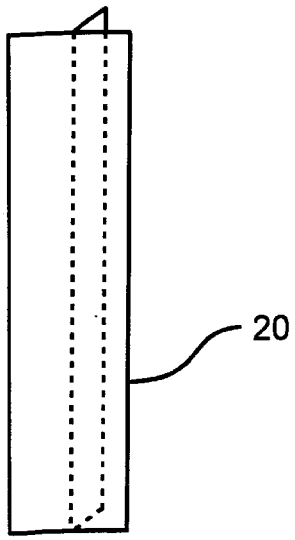
Fig. 12A
Fig. 12B
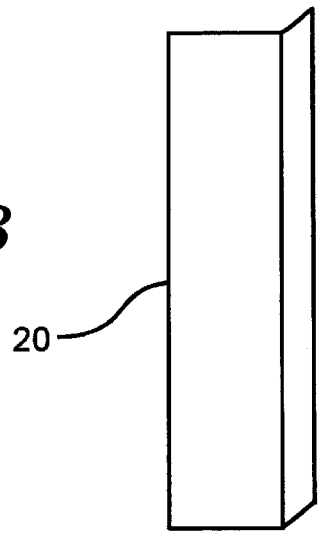
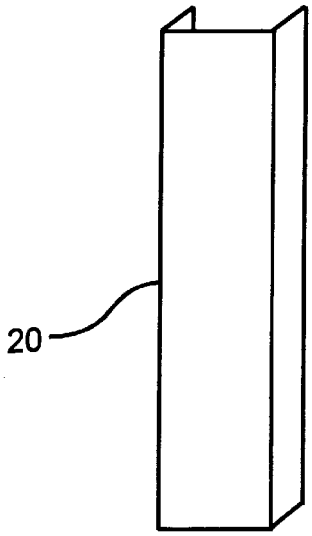
Fig. 12C

TRANSFORMER COOLING METHOD AND APPARATUS THEREOF

TECHNICAL FIELD

The present invention relates generally to transformers, and more particularly to a system for cooling transformers.

BACKGROUND OF THE INVENTION

Transformers are used to transfer electric power between circuits that operate at different voltages. A simple model of a transformer consists of two insulated electrical windings, a primary and a secondary, coupled by a common magnetic circuit. When an alternating voltage is applied to the primary winding, an alternating current will flow to a load connected to the secondary winding.

Transformers generally operate near an efficiency of 98–99%. Any losses ordinarily arise from hysteresis and eddy current loss in the core, resistive loss in the windings, and circulating current loss in the structural parts due to proximity of heavy current leads. Although the total loss may be only 1% of the power transmitted, this may be equivalent to 10 MW on a large transformer.

Transformers must be designed to withstand the adverse effects resulting from high voltage and temperature. Well known in the field of cooling transformers, fluid filled transformers incorporate a cooling radiator and circulate a cooling fluid throughout a closed circulatory path formed between the connection of the transformer and the cooling radiator. Careful design is required to avoid overheating the windings which would cause premature aging of the insulation and lead to an electric breakdown in the windings. The choice of cooling methods will greatly determine the quality of the transformer.

Cooling of liquid filled transformers is the process by which the energy losses that are generated in the core and coil assembly are dissipated to the surrounding air. The losses, which appear in the form of heat, must be directed away from the windings to avoid premature deterioration of the insulation. The transfer of heat energy is accomplished through a combination of transfer processes. These processes are conduction, convection and radiation. Conduction is a heat transfer process where heat energy is transferred through a material by the passing of energy from one particle to the next without any mass motion in the material, i.e. a copper rod. Convection is a heat transfer process where heat energy is transferred from one place to another by actual motion of the medium, i.e. a liquid or gas. Radiation is a heat transfer process where heat energy is transferred from one place to another by magnetic waves or particles without any medium playing an active role, i.e. heat from the sun. The individual contributions of each heat transfer process must be added together to determine the total effective cooling for the transformer. The transformer designer can control the contribution of each parameter through the use of cooling ducts, oil column height, tank size and/or area exposed to the cooling air.

Transformers are usually quite large and generate great amounts of heat. Traditional methods of cooling transformers include fluid cooling or immersing the transformer in oil. Transformers cooled by oil immersion may be more efficient at cooling the transformer, however oil immersed transformers pose a risk to the environment through possible contamination resulting from spills during maintenance, repair or damage to the transformer oil tank.

The present invention is provided to solve these and other problems.

SUMMARY OF THE INVENTION

The present invention is a transformer apparatus and a method for cooling a transformer. According to one aspect of the invention, a transformer is provided having a plurality of cooling panels with each panel having an exterior end. A plate is positioned toward at least a portion of the exterior ends of the cooling panels, thus forming a flow path for increased velocity of air therein.

A second aspect of the present invention relates to a fluid cooled transformer having a plurality of cooling panels with each panel having an exterior end. A plate is positioned toward at least a portion of the exterior ends of the cooling panels, thus forming a flow path for increased velocity of air therein.

A third aspect of the present invention relates to a radiator for a transformer, the radiator having a plurality of cooling panels with each panel having an exterior end. A plate is positioned toward at least a portion of the exterior ends of the cooling panels forming a flow path for increased fluid velocity therein.

A fourth aspect of the present invention involves a fluid cooled transformer comprising a plurality of cooling panels with each panel having an exterior end. A plate is positioned toward at least a portion of the exterior ends of the panels for substantially enclosing a flow path between the exterior ends, thereby increasing the velocity of air therein.

A further aspect of the present invention involves a fluid cooled transformer comprising a plurality of cooling panels, each panel having an exterior end and a cooling plate extending therefrom. Positioning multiple panels adjacent each other forms a flow path between the plate and the adjacent cooling panels, thereby increasing the velocity of air therein. It is also contemplated by this invention that at least one cooling plate is attached to each cooling panel.

Another aspect of the present invention relates to fluid cooled transformers having a plurality of conduits fluidly connected perpendicularly to the cooling panels and also fluidly connected to the transformer.

Yet another aspect of the present invention involves a method of cooling a transformer having a plurality of cooling panels with each panel having an exterior end. The method of cooling comprises the steps of providing a plate and forming a flow path by positioning the plate toward at least a portion of the exterior ends for substantially enclosing the flow path between the cooling panels, thereby increasing the velocity of air traveling within the flow path.

It is also contemplated by this invention that the plates used to enclose a flow path are substantially solid.

Other advantages and aspects of the present invention will become apparent upon reading the following description of the drawings and detailed description of the invention.

BRIEF DESCRIPTION OF THE DRAWINGS

The file of this patent contains at least one drawing executed in color. Copies of this patent with color drawing(s) will be provided by the Patent and Trademark Office upon request and payment of the necessary fee.

FIG. 12*a* is an alternative embodiment of a cooling plate;

FIG. 12*b* is an alternative embodiment of a cooling plate;

FIG. 12*c* is an alternative embodiment of a cooling plate;

DETAILED DESCRIPTION OF THE PREFERRED EMBODIMENT

Figure 1:
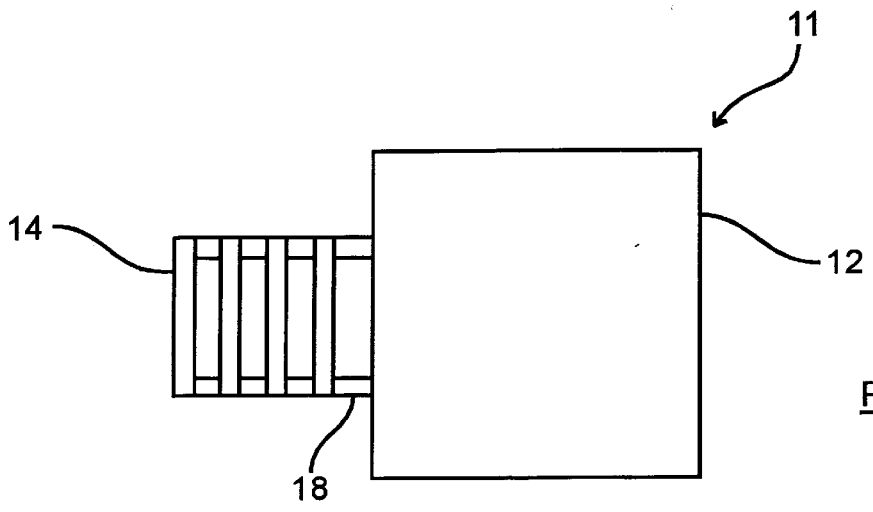
PRIOR ART Fig. 1
FIG. 1 is a front view of a liquid filled transformer in use prior to the present invention.
Figure 2:
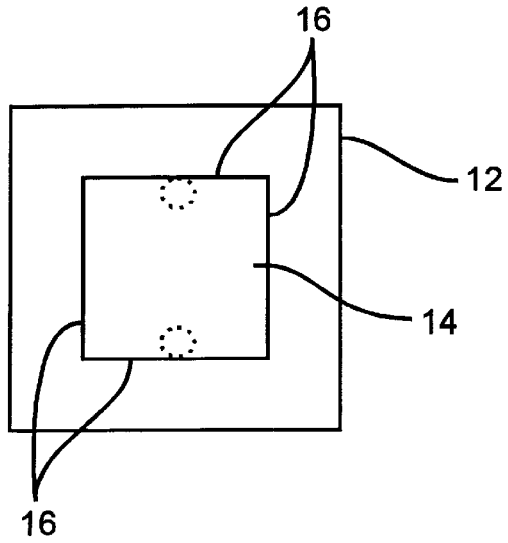
PRIOR ART Fig. 2
FIG. 2 is a left side view of the liquid filled transformer and cooling radiator of FIG. 1.

While this invention is susceptible of embodiment in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 3:
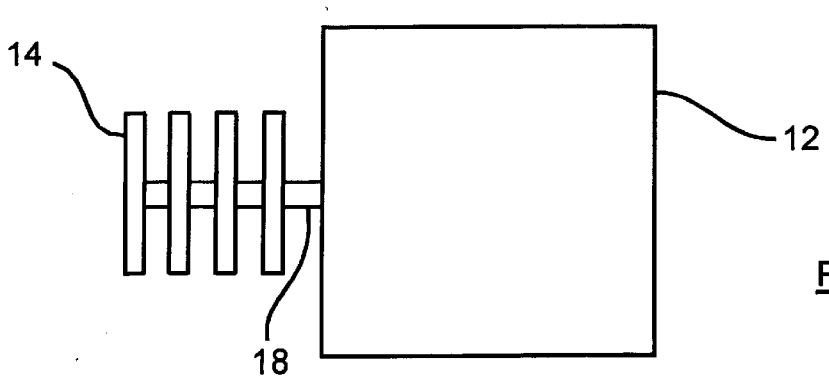
PRIOR ART Fig. 3
FIG. 3 is a top view of the preferred embodiment of the liquid filled transformer and cooling radiator of FIG. 1.
Figure 3A:
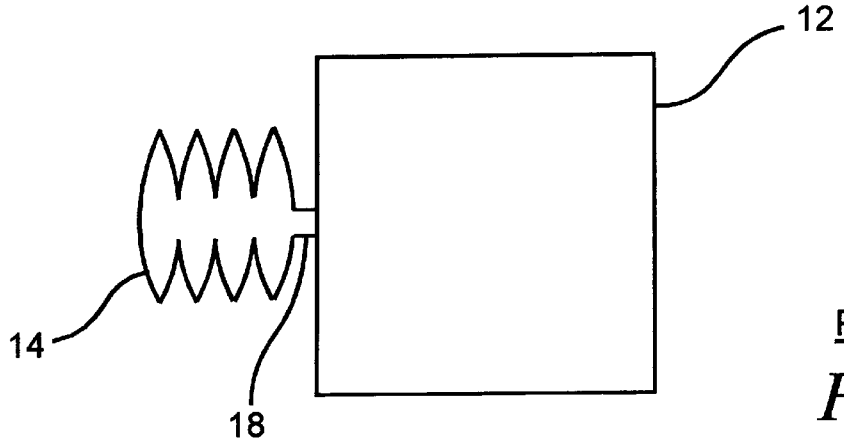
PRIOR ART Fig. 3A
FIG. 3*a* is a top view of an alternative embodiment of the liquid filled transformer and cooling radiator.
Figure 4:
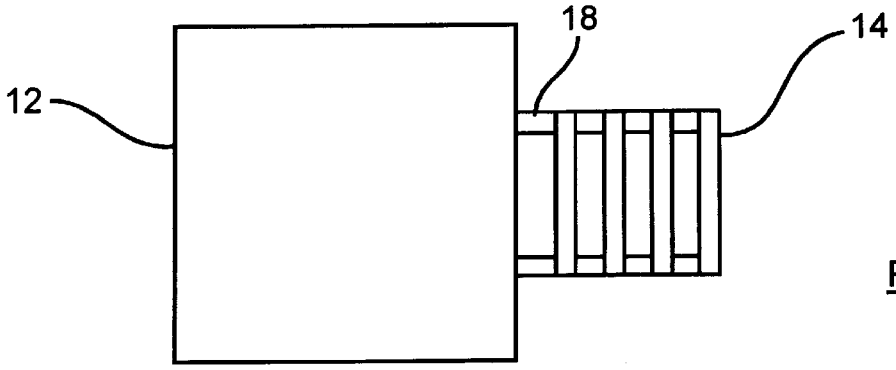
PRIOR ART Fig. 4
FIG. 4 is a rear view of the liquid filled transformer and cooling radiator of FIG. 1.
Figure 5:
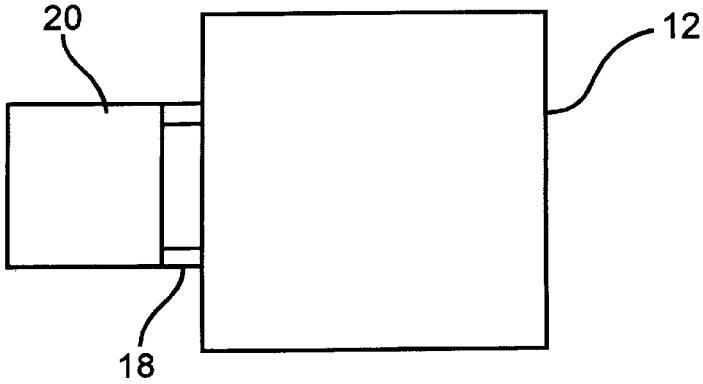
FIG. 5 is a front view of the cooling plates of the present invention incorporated on the transformer of FIG. 1.
Figure 6:
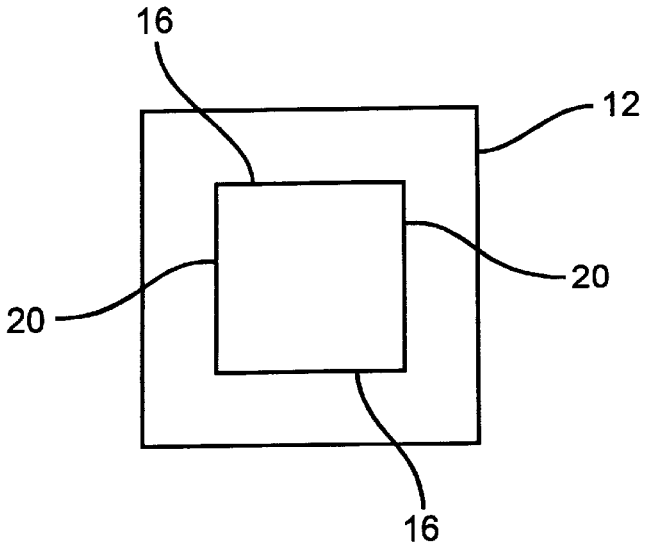
FIG. 6 is a left side view of the transformer and cooling plates of FIG. 5.

With reference to FIGS. 1–4, the cooling system 11 generally includes a plurality of cooling panels 14 with each panel 14 having an exterior end 16. The cooling panels 14 are liquidly connected to the transformer 12 as shown in FIG. 3*a*. Preferably, a conduit 18 joins the cooling panels 14 and the transformer 12 as shown in FIG. 1. Thus, a closed circulatory path comprising the cooling panels 14, conduit 18, and transformer 12 is created.

Although the shape of a cooling panel 14 is generally planar, it may vary in shape and size. The cooling panel 14 has an exterior end 16 and is typically hollow and capable of holding a fluid. Generally, a plurality of cooling panels 14 are vertically positioned in parallel to each other and fluidly connected between themselves and the transformer 12. Preferably, the cooling panels 14 are fluidly connected to each other and the transformer 12 by a conduit 18. Thus, a circulatory path is formed comprising the transformer 12, the conduits 18 and the cooling panels 14.

A working transformer 12 generates heat. The cooling liquid (not shown) within the transformer 12 is heated by the transformer. The ambient air temperature surrounding the transformer 12 is cooler than the cooling liquid within the transformer 12. The heated cooling fluid that temporarily resides within the cooling panels 14 heats the stagnant, ambient air surrounding the cooling panels 14. As the stagnant air heats up, it becomes less dense. The less dense air displaces the denser air and begins to rise. As the less dense air moves up, it facilitates the transfer of heat from the panels 14 to the air, thus cooling the liquid within the panels 14. Similarly, as the liquid within the panels 14 cools, it flows up and eventually returns to cool the transformer 12.

Convection is a function of the velocity of the medium used, i.e., air or fluid. Initially the heat transfers to the stagnant, ambient air surrounding the is panels 14 by conduction. After the air begins to move, heat transfer by convection occurs. As the velocity of the air flowing between the cooling panels 14 increases, the efficiency of the heat transfer is increased.

Figure 7:
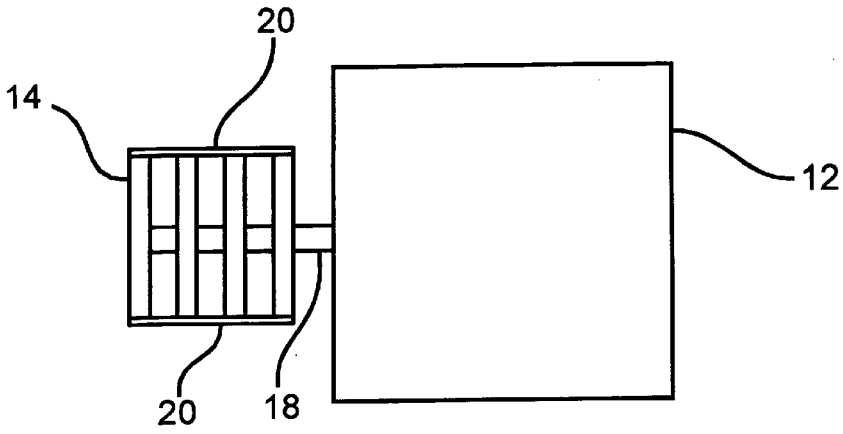
FIG. 7 is the top view of the present invention shown in FIG. 5.
Figure 7A:
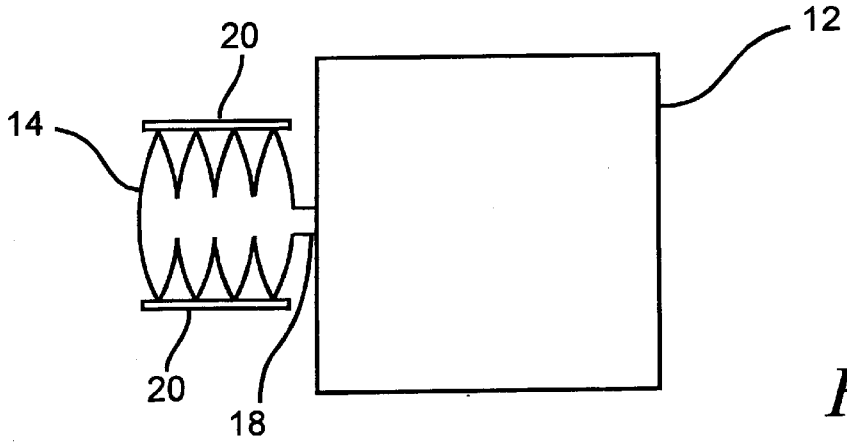
FIG. 7*a* is a top view of the cooling plates incorporated on the alternative embodiment shown in FIG. 3*a;*

With further reference to FIGS. 5–11, the transformer further includes plates 20 positioned toward the exterior edges 16 of the cooling panels 14, thus creating a flow path between the cooling panels 14 and the plates 20. The plates 20 close off the open sides of the panels 14 near their exterior ends 16, creating a chimney. See FIGS. 7 and 7*a*. Since the previously opened side areas are blocked off by the additional placement of the plates 20, air flow through the flow path is confined to the top and bottom openings of the "chimney." See FIG. 10. The use of the plates 20 increases the air flow between the panels 14 as opposed to when the plates are not used. The increased air flow cools the liquid within the panels 14 at a faster rate. Obviously, larger panels 14 may facilitate faster cooling of the liquid, nevertheless, the creation of a flow path, i.e., chimney, by placing the plates 20 adjacent the panels 14 will improve the cooling efficiency of a cooling system 11 incorporating panels 14 as shown in this application.

Figure 7B:
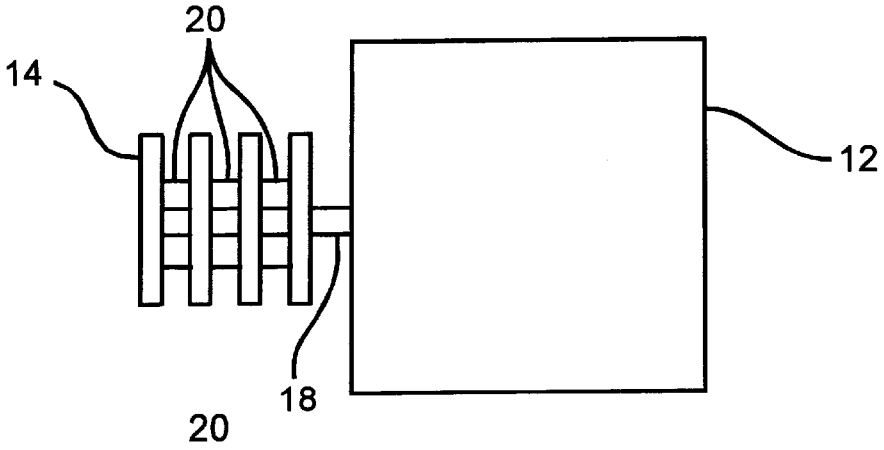
FIG. 7*b* is a top view of an alternative embodiment of the present invention.
Figure 7C:
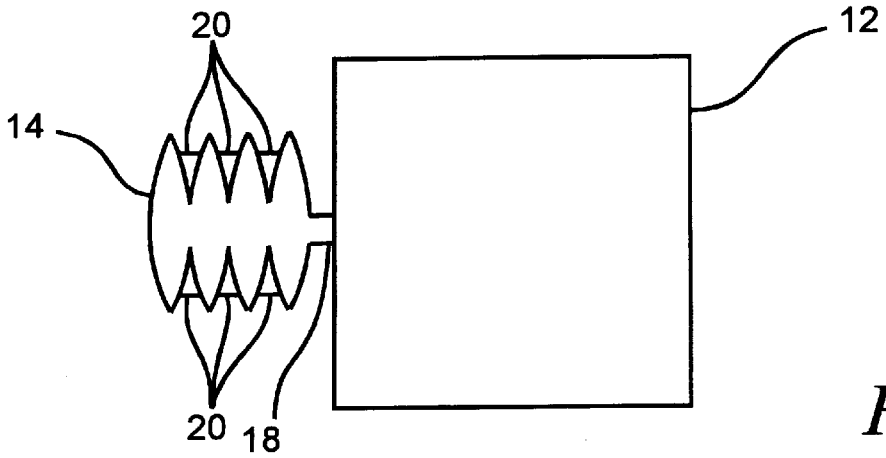
FIG. 7*c* is a top view of an alternative embodiment of the present invention.
Figure 7D:
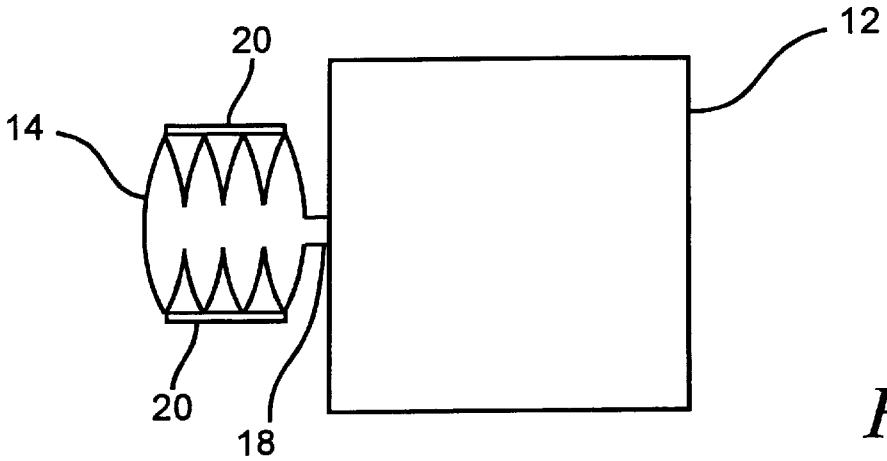
FIG. 7*d* is a top view of an alternative embodiment of the present invention.
Figure 7E:
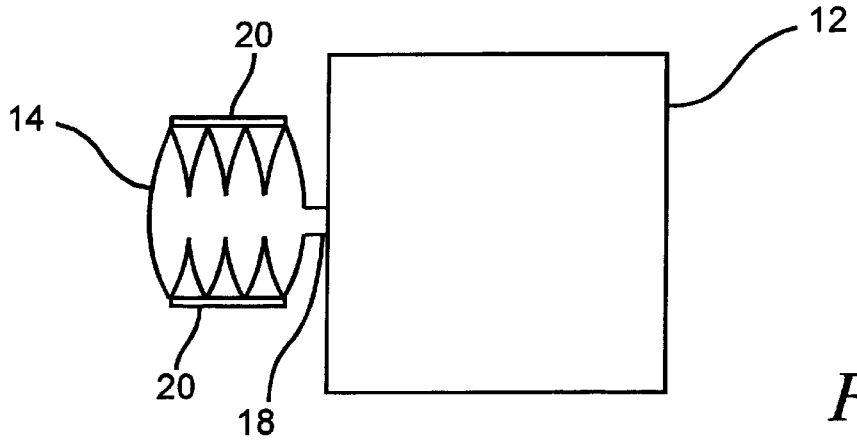
FIG. 7*e* is a top view of an alternative embodiment of the present invention.
Figure 8:
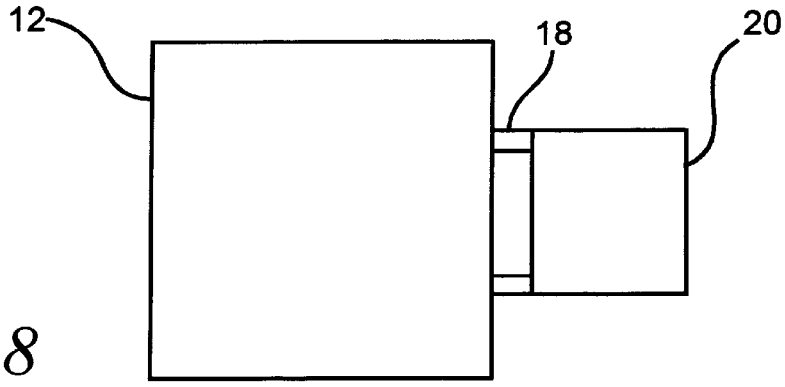
FIG. 8 is the rear view of the liquid filled transformer and cooling radiator of FIG. 5.
Figure 9:
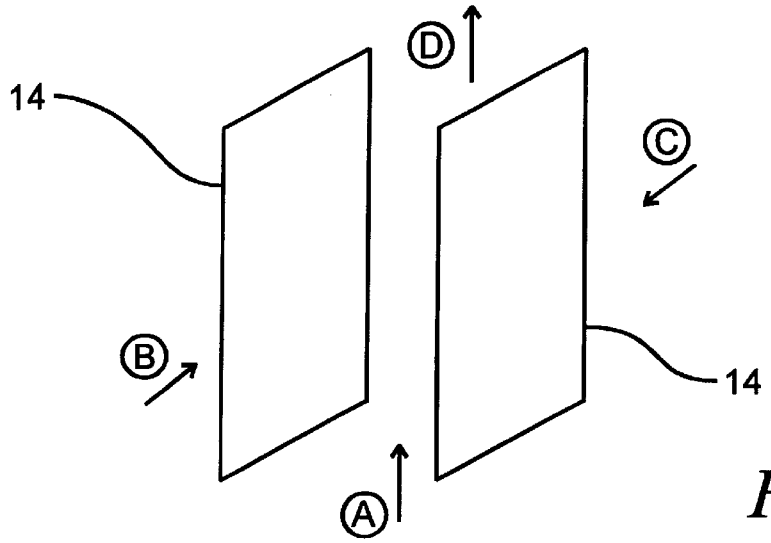
FIG. 9 is a simulation diagram of two parallel panels configured during testing simulation without the plates installed.
Figure 10:
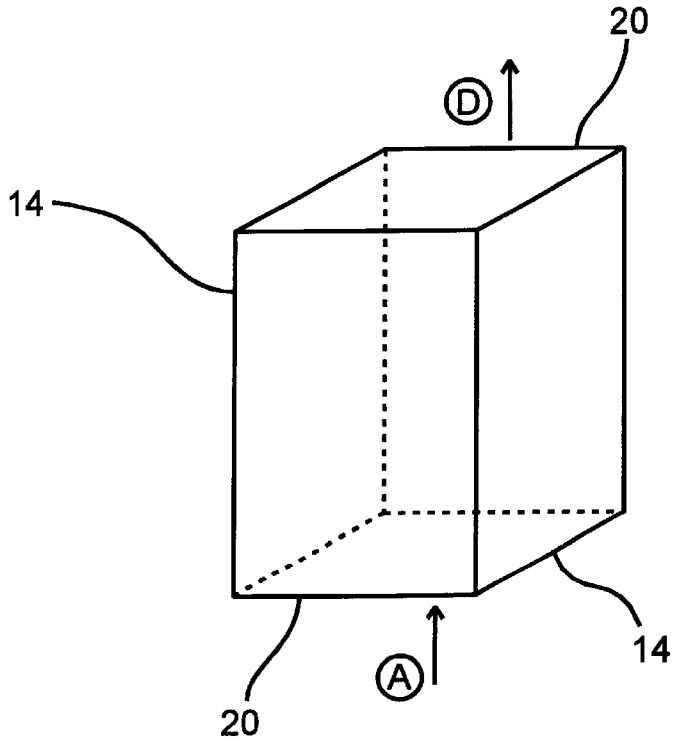
FIG. 10 is a simulation diagram of two parallel panels configured during testing simulation with the plates installed.
Figure 11A:
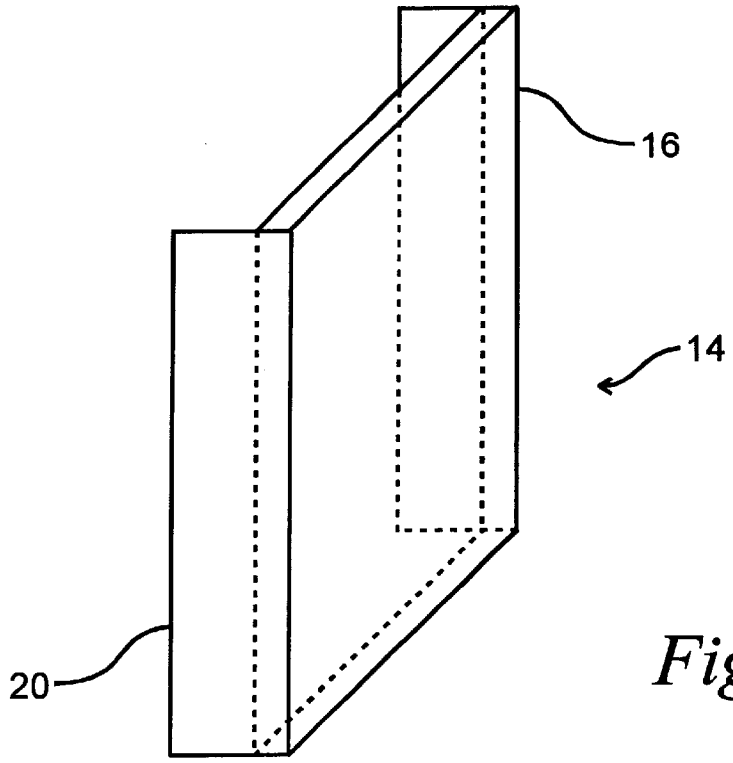
FIG. 11*a* is an alternative embodiment of the cooling panel having a plate.
Figure 11B:
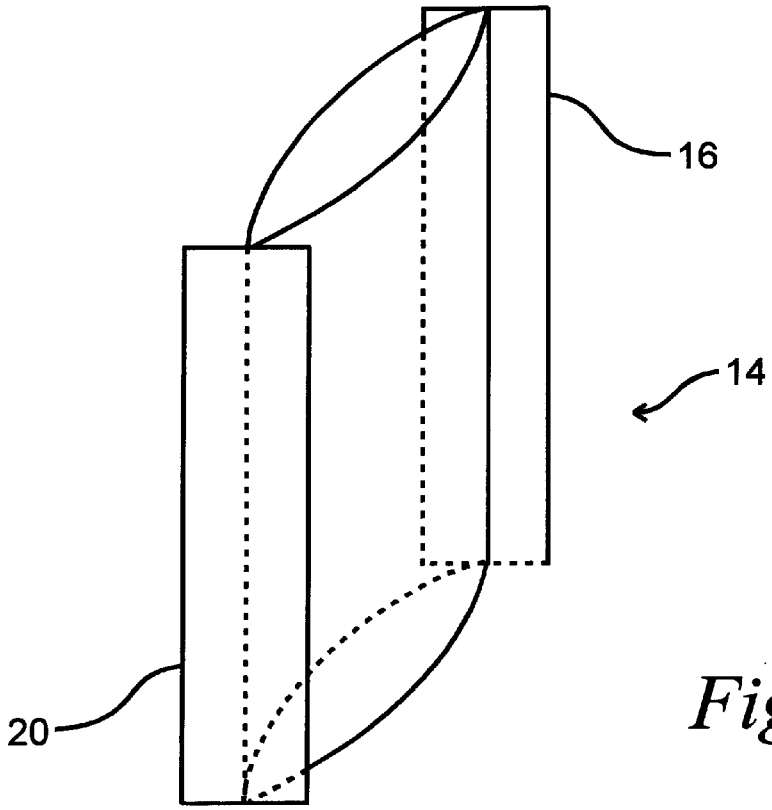
FIG. 11*b* is and alternative embodiment of the cooling panel having a plate.
Figure 11C:
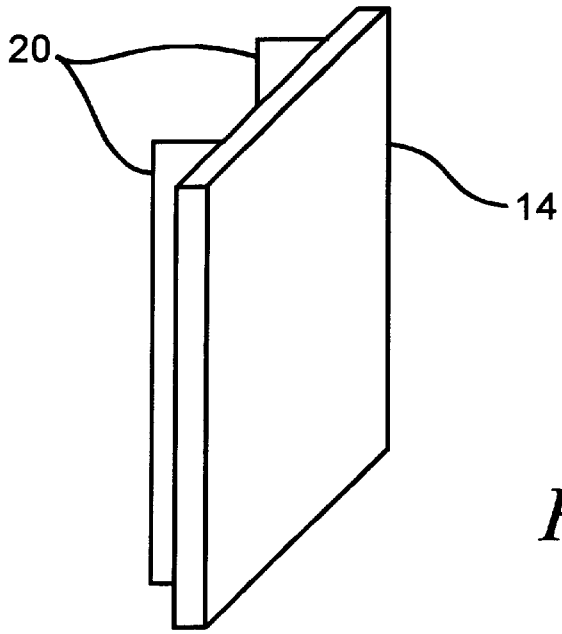
FIG. 11*c* is and alternative embodiment of the cooling panel having a plate.

Alternative embodiments of the present invention contemplate incorporating individual cooling panels 14 each having an exterior end 16 and a plate 20 extending therefrom as shown in FIGS. 11*a,* 11*b* and 11*c*. A flow path is created between the plate 20 and the adjacent cooling panels 14. It is also contemplated by this invention that separate, individual plates 20, as shown in FIGS. 12*a,* 12*b,* and 12*c,* may be attached at or near the exterior end 16 of each cooling panel 14 for substantially enclosing a flow path between the adjacent panels 14 and the plate 20 thereby increasing the velocity of air therein. See FIGS. 7*d* and 7*e*. It is further contemplated by this invention that separate, individual cooling plates 20, as shown in FIGS. 12*a,* 12*b* and 12*c,* may be attached between adjacent cooling panels 14 for substantially enclosing a flow path between the adjacent panels 14 and the plate 20 thereby increasing the velocity of air therein. See FIGS. 7*b* and 7*c*.

With reference to FIGS. 9, 10 and 14–17, a simulation was run for calculating the total air flow adjacent the cooling panels 14 when the plates 20 are used and not used. The cooling panels 14 were constructed out of gray painted eighteen (18) gauge mild steel. The air temperature was set at 30° C., the cooling panel 14 temperature was set at 80° C. and the cooling plates 20 were set at 40° C. Table 1 below shows the simulated total air flow through the panels 14 without plates 20 installed, see FIG. 9, and with plates 20 installed, see FIG. 10.

TABLE 1

| | Total Air Flow (Kg/s) | |
|---|---|---|
| | Without Plates | With Plates |
| Vent A (bottom) | $3.017 \times 10^{-3}$ | $1.495 \times 10^{-2}$ |
| Vent B (side) | $4.769 \times 10^{-3}$ | |
| Vent C (side) | $4.769 \times 10^{-3}$ | |
| Vent D (top) | $-1.256 \times 10^{-2}$ | $-1.495 \times 10^{-2}$ |

Table 1 also shows the simulated total air flow exiting the top portion of the panels 14 when the plates 20 are not installed is $1.256\times10^{-2}$ Kg/s, as opposed to $1.495\times10^{-2}$ Kg/s when the plates 20 are installed.

Figure 14:
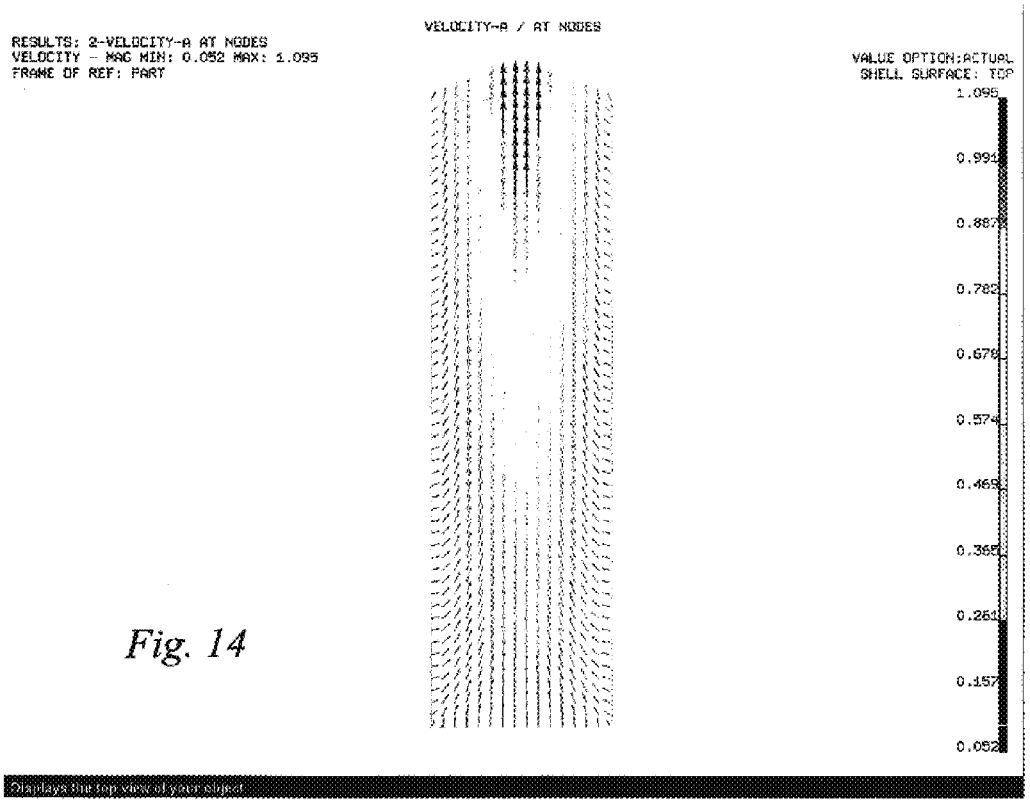
FIG. 14 is a chart depicting the air velocity measured within the simulation diagram of FIG. 9.
Figure 16:
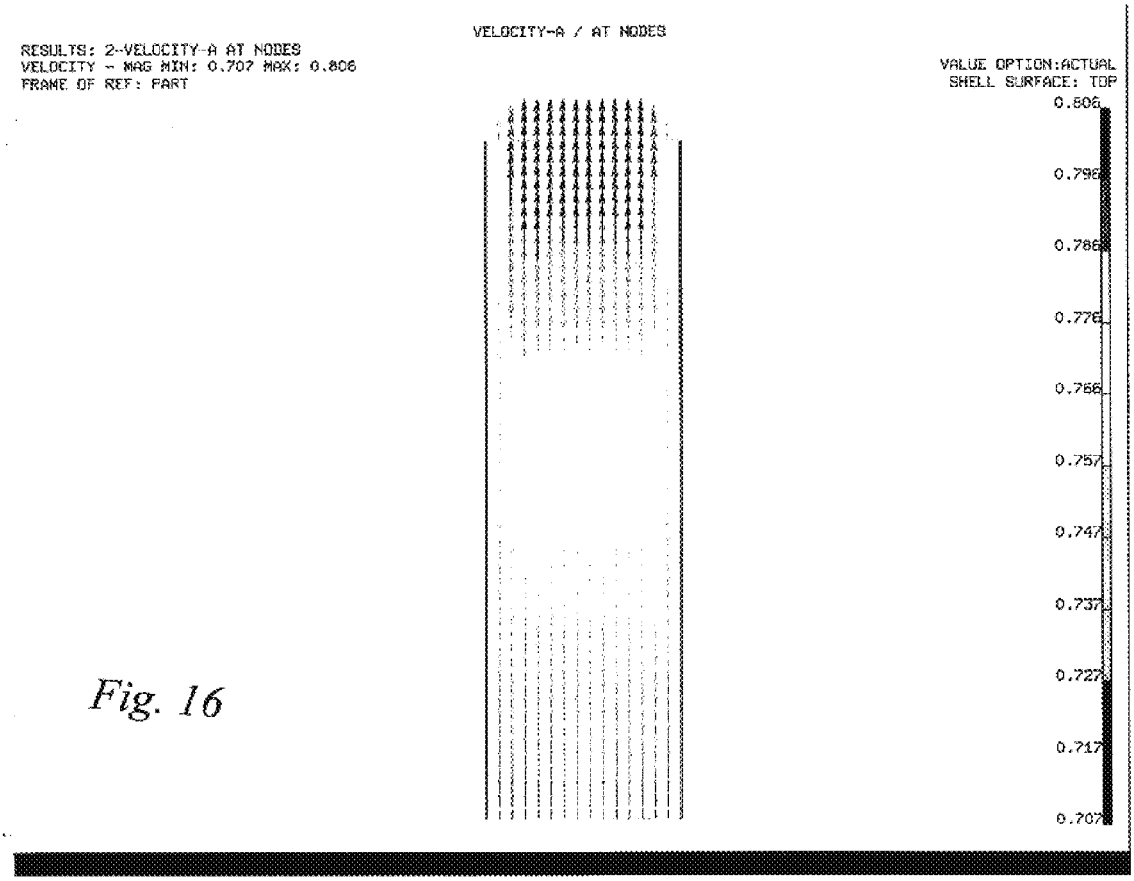
FIG. 16 is a chart depicting the air velocity measured within the simulation diagram of FIG. 10.

The graphs of FIGS. 14 and 16 respectively show the corresponding simulated air velocity between the panels 14 when the plates 20 are not installed and installed.

The average heat transfer coefficient during the simulation is shown in Table 2 below.

TABLE 2

| | Average Heat Transfer Coefficient ($W/m^2$ ° C.) | |
|---|---|---|
| | Without Plates | With Plates |
| Maximum | 9.541 | 9.483 |
| Minimum | 7.518 | 8.413 |
| Average | 8.176 | 8.925 |

As shown in Table 2, the simulated average heat transfer coefficient over the surface of the panels 14 when the plates 20 are not installed is 8.176 $W/m^2$ ° C., as opposed to 8.925 $W/m^2$ ° C. when the plates 20 are installed.

Figure 15:
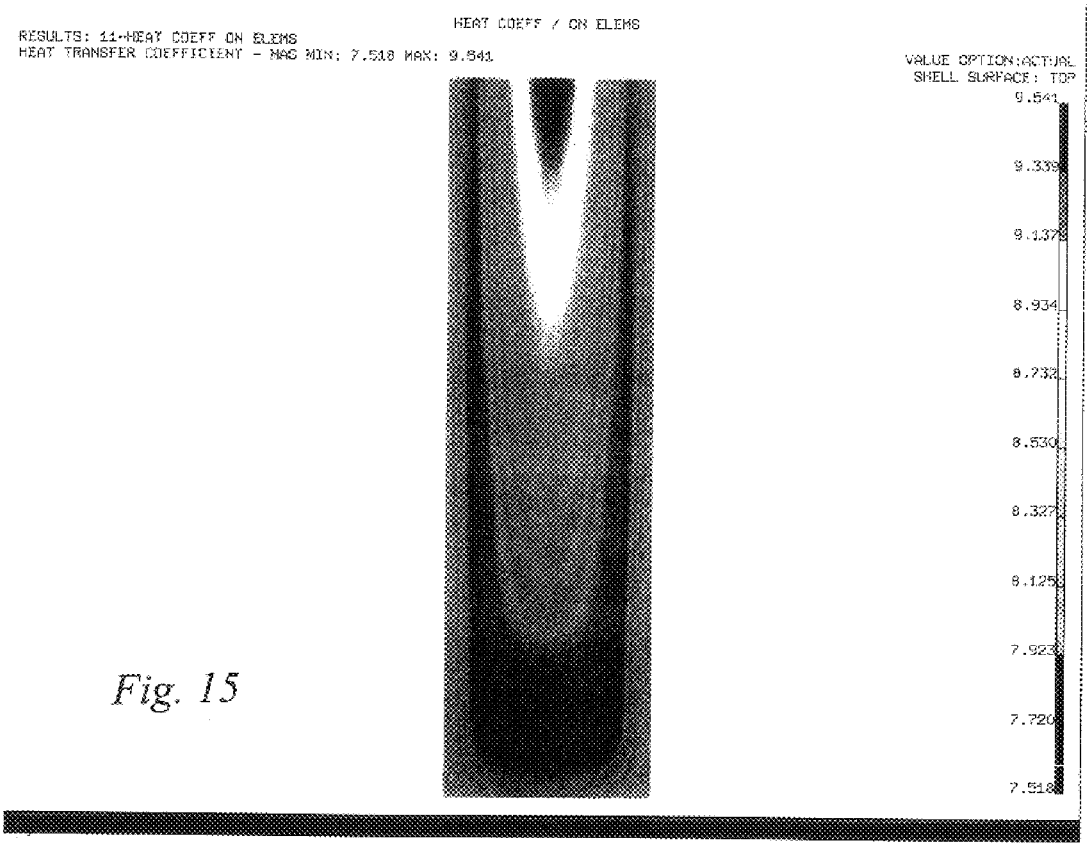
FIG. 15 is a chart depicting the heat coefficient on the surface of the panels depicted in the simulation diagram of FIG. 9.
Figure 17:
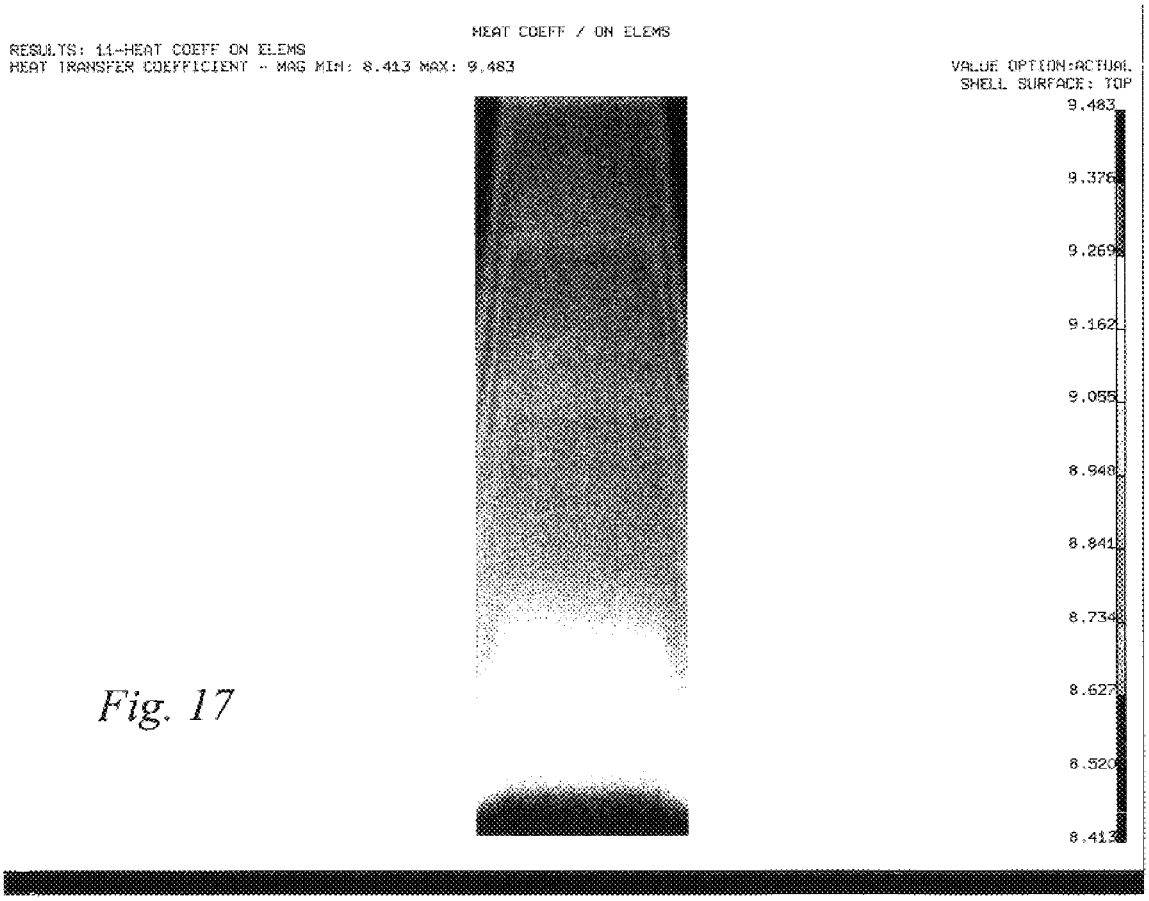
FIG. 17 is a chart depicting the heat coefficient on the surface of the panels depicted in the simulation diagram of FIG. 10.

The graphs of FIGS. 15 and 17 respectively show the corresponding simulated heat coefficient on the surface of the panels 14 when the plates 20 are not installed and installed.

Figure 13:
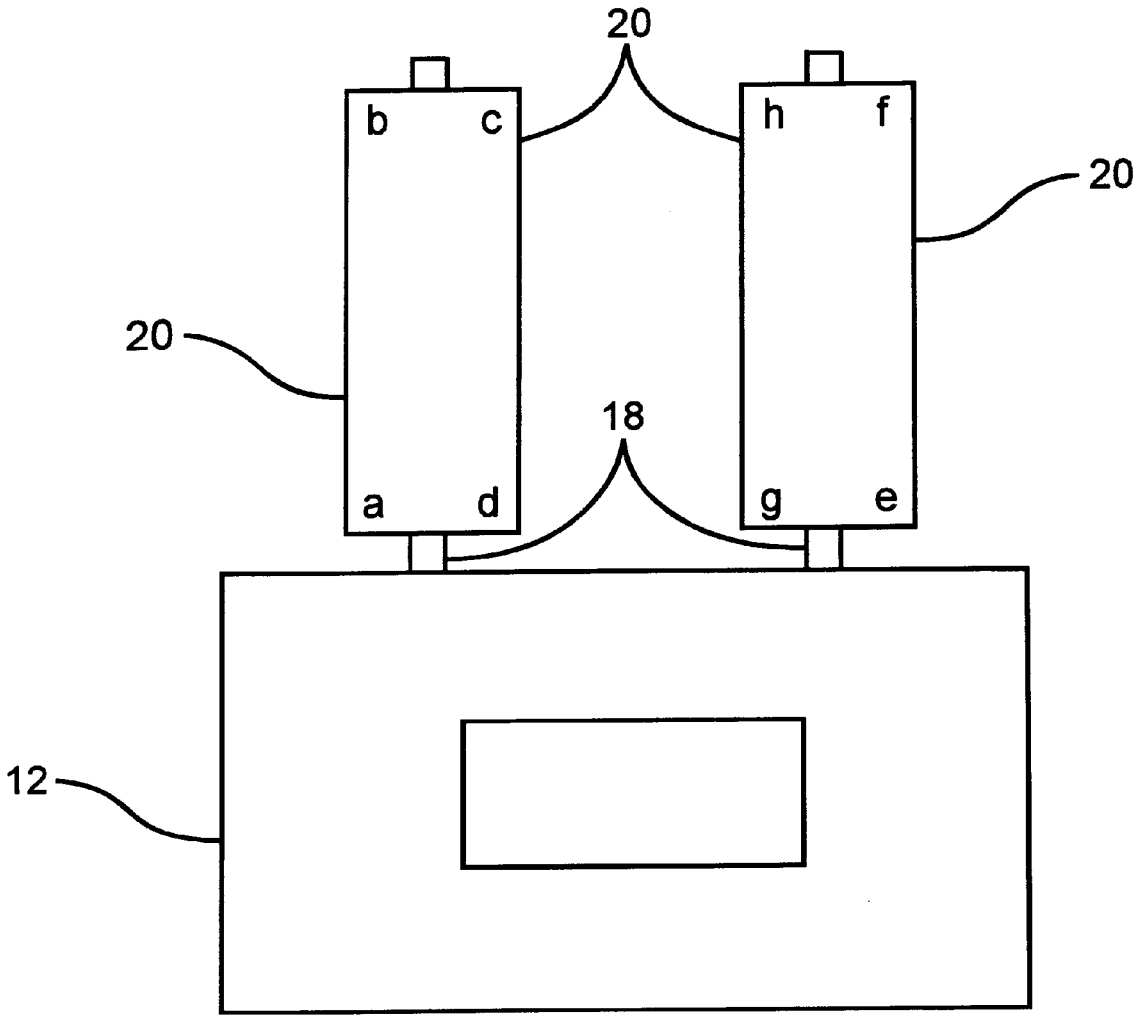
FIG. 13 is a top view of the transformer of the present invention indicating experimental air temperature measurement locations associated with Table 3.

With further reference to FIG. 13, an experiment was performed on the following Square D transformer: Serial No. 980145-A, KVA 500, High Voltage (HV) Volts 13800, Low Voltage (LV) Volts 480Y/277, Panels 26. At a stable condition at rated current, air temperature measurements were taken above the vertical panels 14 at the positions indicated in FIG. 13. The air temperature measurements were recorded and are shown in Table 3 below.

TABLE 3

| | Air Measurements (° C.) | |
|---|---|---|
| Position | Without Plates | With Plates |
| a | 46.8 | 37.4 |
| b | 46.2 | 42.1 |
| c | 49.8 | 45.4 |
| d | 50.2 | 42.3 |
| e | 47.0 | 45.9 |
| f | 46.3 | 46.7 |
| g | 47.1 | 44.7 |
| h | 50.1 | 46.5 |

At the end of each test, the actual system rise over the ambient temperature was determined.

| | | |
|---|---|---|
| Without cooling plates | HV 65.5° C. | LV 61.7° C. |
| With cooling plates | HV 60.6° C. | LV 57.8° C. |

There was a 4.9° C. drop on the HV and a 3.9° C. drop on the LV when the cooling plates 20 were installed.

Energy losses in the form of heat are directed away from the transformer windings through a process or processes known as conduction, convection and radiation. If the transformer surface area exposed to the cooling air is increased, an overall reduction in temperature rise over ambient can be expected. The installation of the cooling plates 20 adjacent the cooling panels 14 increases the surface area of the transformer, in addition to creating a flow path, i.e., "chimney effect," within the space defined by the cooling plates 20 and the cooling panels 14. The chimney effect increases the difference in air densities from top to bottom within the space defined by the cooling plates 20 and the cooling panels 14. This in turn increases the airflow, which increases the air's scrubbing effect across each panel 14. Table 3 above comprises the air temperature measurements taken at the top of the cooling panels 14. The data demonstrates that cooler bottom air is moving upward at a faster rate when the cooling plates 20 are installed. The overall temperature test results indicate that when cooling plates 20 are attached, a 4.9° C. drop on the HV and a 3.9° C. drop on the LV is obtained on the test specimen as compared to when the cooling plates 20 are not attached.

While the specific embodiments have been illustrated and described, numerous modifications come to mind without significantly departing from the spirit of the invention and the scope of protection is only limited by the scope of the accompanying claims.

What is claimed is:

1. An apparatus comprising:

a transformer having a cooling framework with an inner perimeter surface forming an inner perimeter and allowing an external gaseous medium to flow therewithin, wherein the cooling framework comprises a plurality of cooling panels, each cooling panel having an outer end, and a plate, the plate attached near the outer end of the plurality of cooling panels forming the inner perimeter surface, wherein the plurality of cooling panels are disposed within the inner perimeter.

2. The apparatus of claim 1, wherein the cooling framework comprises:

a plurality of conduits fluidly connecting the cooling panels to the transformer.

3. The apparatus of claim 1, wherein the plate is solid.

4. The apparatus of claim 1, wherein the plate is rectangular in shape.

5. The apparatus of claim 1, wherein the plate is flat.

6. The apparatus of claim 1, wherein the plate is comprised of metal.

7. A method of cooling a transformer having a plurality of of cooling panels, each panel having an exterior end, the method comprising the steps of:

providing a plate; and, positioning the plate to form an inner perimeter surface having an inner perimeter, wherein an external gaseous medium flows therewithin, the plurality of cooling panels are disposed within the inner perimeter.

8. The method of claim 7 wherein the plate is solid.

9. The method of claim 7 wherein the plate is comprised of metal.

10. The method of claim 7 wherein the plate is rectangular in shape.

11. The method of claim 7 wherein the plate is flat.

12. A fluid cooled transformer comprising:

at least one cooling panel having at least one exterior end; and, a plate attached toward the at least one exterior end forming a cross-sectional inner perimeter surface having an inner perimeter and allowing an external gaseous medium to flow therewithin, wherein the at least one cooling panel is disposed within the inner perimeter.

13. The fluid cooled transformer of claim 12 wherein the plate is substantially perpendicular to the cooling panels.

14. The fluid cooled transformer of claim 12 wherein the plate is solid.

15. The fluid cooled transformer of claim 12 wherein the plate is comprised of metal.

16. The fluid cooled transformer of claim 12 wherein the plate is rectangular in shape.

17. The method of claim 12 wherein the cross-sectional inner perimeter surface is continuous.

18. An apparatus comprising:

a transformer having a plurality of adjacent cooling panels, the cooling panels each having an exterior end; and, a plurality of plates, the plates each having a first and second end, the first end of the plate attached to one of the cooling panels and the second end of the plate attached to the adjacent cooling panel, the adjacent cooling panels and plate forming an inner perimeter surface to allow an external gaseous medium to flow therewithin, wherein the cooling panels are disposed within the inner perimeter.

19. The apparatus of claim 18, wherein the first and second ends of the plate are attached near the exterior ends of the cooling panels.

20. A transformer comprising:

a plurality of cooling panels, the cooling panels each having an exterior end; and, a plurality of plates, the plates each having a mid section and two outer sections, the mid section attached near the exterior end of the cooling panels forming a flow path having an inner perimeter surface allowing a gaseous medium to flow therewithin.

21. In a radiator for a transformer, the radiator having a plurality of cooling panels, the radiator comprising:

an inner perimeter surface forming an inner perimeter and allowing an external gaseous medium to flow therewithin, wherein the plurality of cooling panels are disposed within the inner perimeter.

22. An apparatus comprising:

a transformer having a cooling framework with an inner perimeter surface forming an inner perimeter and allowing an external gaseous medium to flow therewithin, wherein the cooling framework comprises a plurality of cooling panels, each cooling panel having an outer end, and a plate, the plate attached near the outer end of the plurality of cooling panels, wherein the plurality of cooling panels and the plate define the inner perimeter, wherein the plurality of cooling panels are disposed within the inner perimeter.

* * * * *